US011124384B2

(12) United States Patent
Rush

(10) Patent No.: US 11,124,384 B2
(45) Date of Patent: Sep. 21, 2021

(54) METHOD FOR TENSIONING OF A LOAD BEARING MEMBER OF AN ELEVATOR SYSTEM

(71) Applicant: Otis Elevator Company, Farmington, CT (US)

(72) Inventor: Daniel Rush, Canton, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 687 days.

(21) Appl. No.: 15/981,207

(22) Filed: May 16, 2018

(65) Prior Publication Data

US 2018/0334358 A1 Nov. 22, 2018

Related U.S. Application Data

(60) Provisional application No. 62/506,891, filed on May 16, 2017.

(51) Int. Cl.
*B66B 5/00* (2006.01)
*B66B 7/10* (2006.01)

(52) U.S. Cl.
CPC ..... *B66B 5/0087* (2013.01); *B66B 5/0018* (2013.01); *B66B 7/10* (2013.01)

(58) Field of Classification Search
CPC ..... B66B 5/00; B66B 5/0018; B66B 1/3484; B66B 5/0025; B66B 5/0087; B66B 7/10; B66B 5/0037; B66B 1/3476; B66B 7/06; B66B 7/1215; B66B 11/06; B66B 1/30; B66B 9/025; B66B 7/025; B66B 1/44; B66B 11/04; B66B 11/0446; B66B 11/08
See application file for complete search history.

(56) References Cited

U.S. PATENT DOCUMENTS 5,149,922 A 9/1992 Kondou
5,731,528 A 3/1998 Yamazaki et al.
(Continued)

FOREIGN PATENT DOCUMENTS

CN 102906001 A 1/2013
CN 103502132 A 1/2014
(Continued)

OTHER PUBLICATIONS

European Search Report Issued in EP Application No. 18172166.3; dated Nov. 12, 2018, 16 Pages.
(Continued)

*Primary Examiner* — Marlon T Fletcher
(74) *Attorney, Agent, or Firm* — Cantor Colburn LLP

(57) ABSTRACT

A method of tension adjustment for a load bearing member of an elevator system includes measuring a load on a load bearing member of an elevator system via a load cell operably connected to the load bearing member, the load cell and the load bearing member connected to an elevator car disposed in a hoistway, the measured load equated with a tension of the load bearing member. The measured tension to a preselected range and an adjustment of the tension of the load bearing member is determined. Adjustment instructions are communicated to a handheld electronic device and the communicated adjustment instructions are performed thereby adjusting the tension of the load bearing member to within the preselected range.

15 Claims, 6 Drawing Sheets

(56) References Cited

U.S. PATENT DOCUMENTS

| | | | | |
|---|---|---|---|---|
| 5,877,431 | A | 3/1999 | Hirano | |
| 6,123,176 | A * | 9/2000 | O'Donnell | B66B 7/1215 187/393 |
| 7,237,656 | B2 | 7/2007 | Barrett et al. | |
| 7,409,870 | B2 | 8/2008 | Stucky et al. | |
| 7,540,359 | B2 | 6/2009 | Veronesi et al. | |
| 7,686,140 | B2 | 3/2010 | Rossignol et al. | |
| 7,801,690 | B2 | 9/2010 | Veronesi et al. | |
| 8,011,479 | B2 | 9/2011 | Stucky et al. | |
| 8,686,747 | B2 | 4/2014 | Berner et al. | |
| 8,851,239 | B2 | 10/2014 | Nakamori | |
| 9,182,300 | B2 | 11/2015 | Themm et al. | |
| 9,423,369 | B2 | 8/2016 | Fargo et al. | |
| 2013/0056304 | A1 * | 3/2013 | Sanchez | B66B 7/062 187/255 |
| 2013/0112508 | A1 * | 5/2013 | Jun | F16H 1/36 187/412 |
| 2014/0124300 | A1 * | 5/2014 | Benosman | B66B 7/06 187/247 |
| 2014/0167980 | A1 | 6/2014 | Sonneborn et al. | |
| 2014/0182974 | A1 * | 7/2014 | Puranen | B66B 5/0018 187/247 |
| 2015/0247769 | A1 | 9/2015 | Miyata et al. | |
| 2015/0253181 | A1 | 9/2015 | Miyata et al. | |
| 2015/0276522 | A1 | 10/2015 | Miyata et al. | |
| 2015/0291396 | A1 * | 10/2015 | Nakamura | B66B 7/048 187/404 |
| 2015/0362450 | A1 * | 12/2015 | Lehtinen | G01N 27/20 187/391 |
| 2015/0375963 | A1 * | 12/2015 | Sun | B66B 5/0031 187/254 |
| 2018/0334358 | A1 * | 11/2018 | Rush | B66B 5/0018 |
| 2018/0362294 | A1 * | 12/2018 | Martin | B66B 1/3484 |
| 2019/0177127 | A1 * | 6/2019 | Duvall | B66B 7/10 |

FOREIGN PATENT DOCUMENTS

| | | | |
|---|---|---|---|
| JP | 07206319 | A | 8/1995 |
| JP | 2011195293 | A | 10/2011 |
| JP | 5268978 | B2 | 8/2013 |
| WO | 2017037313 | A1 | 3/2017 |

OTHER PUBLICATIONS

Chinese Office Action Issued in CN Application No. 201810464713.1, dated Jul. 3, 2019, 9 Pages.

Goggle Play; "Belt tension meter—Apps on Google Play", 2018 Google, Accessed Online: May 15, 2018, 3 Pages. URL: https://play.google.com/store/apps/details?id=jp.gr.java_conf.kotokotobokan.onpa3.

Goggle Play; "Easy Tension—Apps on Google Play", 2018 Google, Accessed Online: May 15, 2018, 3 Pages. URL: https://play.google.com/store/apps/details?id=air.com.hutchinsontransmission.tensiometre.

Goggle Play; "Tension2Go—Apps on Google Play", 2018 Google, Accessed Online: May 15, 2018, 2 Pages. URL: https://play.google.com/store/apps/details?id=com.contitech.ptg.Tension2Go.

* cited by examiner

METHOD FOR TENSIONING OF A LOAD BEARING MEMBER OF AN ELEVATOR SYSTEM

CROSS-REFERENCE TO RELATED APPLICATIONS

This application claims the benefit of 62/506,891, filed May 16, 2017, which is incorporated herein by reference in its entirety.

BACKGROUND

Exemplary embodiments pertain to the art of elevator systems, and more particularly to tensioning of load bearing members of elevator systems.

Elevator systems typically include one or more elevator cars movable along a hoistway to convey passengers and/or goods. The elevator car is suspended in and/or driven along the hoistway by one or more load bearing members, such as a rope or a belt. It is desired that the load bearing member is under a tension load within a selected range when the elevator car is in a selected position in the hoistway. Additionally, when multiple load bearing members are used to suspend and/or drive the elevator car, it is desired that the multiple load bearing members share the tension load equally, and are thus each under the same tension load.

Load bearing member tension springs are connected to each load bearing member and are typically located at terminations of the load bearing members, which may be at the elevator car, for example, or at a fixed location in the hoistway, depending on elevator system configuration. During typical elevator system setup and maintenance, heights of the tension springs along a spring axis for each of the load bearing members is measured and is utilized as an indicator of tension of each load bearing member, and of relative tension between load bearing members in systems having multiple load bearing members.

Once measured, the spring heights may be adjusted by adjusting mechanisms at each spring to attempt to achieve a balanced load bearing member tension. The spring heights are remeasured, and the spring heights readjusted iteratively until a desired tension is achieved. This process is time consuming, and inaccurate, due to the iterative nature of the process and because the process relies on the spring constant of the tension springs being equal, and this is not necessarily the case. Further, the iterative nature exposes service technicians to prolonged periods in the hoistway to perform these operations, which is not desired. Further, the tension distribution can vary with position of the elevator car in the hoistway.

BRIEF DESCRIPTION

In one embodiment, a method of tension adjustment for a load bearing member of an elevator system includes measuring a load on a load bearing member of an elevator system via a load cell operably connected to the load bearing member, the load cell and the load bearing member connected to an elevator car disposed in a hoistway, the measured load equated with a tension of the load bearing member. The measured tension to a preselected range and an adjustment of the tension of the load bearing member is determined. Adjustment instructions are communicated to a handheld electronic device and the communicated adjustment instructions are performed thereby adjusting the tension of the load bearing member to within the preselected range.

Additionally or alternatively, in this or other embodiments a compensation factor is applied to the measured tension based on location of the elevator car in the hoistway.

Additionally or alternatively, in this or other embodiments the elevator car is moved to another location in the hoistway and the load on the load bearing member is remeasured.

Additionally or alternatively, in this or other embodiments the tension on the load bearing member is adjusted by turning a nut at a connection of the load bearing member to the elevator car.

Additionally or alternatively, in this or other embodiments the elevator system includes a plurality of load bearing members, the method further including measuring a load of each load bearing member of the plurality of load bearing members via a corresponding plurality of load cells operably connected to each load bearing member of the plurality of load bearing members, each measured load equating to a tension of the corresponding load bearing member. A distribution of the measured tensions of the load bearing members is evaluated, and the adjustment of the tension each load bearing member of the plurality of load bearing members based on the evaluation of the distribution of measured tensions.

Additionally or alternatively, in this or other embodiments the tension of each load bearing member of the plurality of load bearing members is adjusted to achieve a preselected distribution of the measured tensions.

Additionally or alternatively, in this or other embodiments the plurality of load bearing members are three or more load bearing members.

Additionally or alternatively, in this or other embodiments a learn run is performed, including measuring a load on each load bearing member of the plurality of load bearing members at multiple positions in the hoistway, determining a minimum average load variation between the measured loads, and utilizing the minimum average load variation in the determining the adjustment.

Additionally or alternatively, in this or other embodiments the steps of comparing the measured tension to a preselected range and determining an adjustment of the tension of the load bearing member are performed at the handheld electronic device.

Additionally or alternatively, in this or other embodiments the handheld electronic device is one of a smart phone or a tablet.

In another embodiment, a system for adjusting tension of a plurality of load bearing members of an elevator system includes a plurality of load cells, each load cell operably connected to a load bearing member of the plurality of load bearing members, each load cell configured to measure a load at the load bearing member, the measured load equating to a tension on the corresponding load bearing member. A controller is operably connected to the plurality of load cells and is configured to evaluate the plurality of measured tensions with respect to one or more preselected ranges, and determine an adjustment instruction of each tension of each load bearing member of the plurality of load bearing members. A handheld electronic is operably connected to the controller configured to receive the adjustment instruction of each load bearing members of the plurality of load bearing members.

Additionally or alternatively, in this or other embodiments a nut is operably connected to each load bearing member of the plurality of load bearing members, wherein rotation of the nut adjusts the tension of the associated load bearing member.

Additionally or alternatively, in this or other embodiments the handheld electronic device is wirelessly connected to the controller.

Additionally or alternatively, in this or other embodiments the handheld electronic device is one of a smart phone or a tablet.

Additionally or alternatively, in this or other embodiments the plurality of load bearing members is three or more load bearing members.

Additionally or alternatively, in this or other embodiments the plurality of load bearing members include a plurality of ropes or a plurality of belts.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
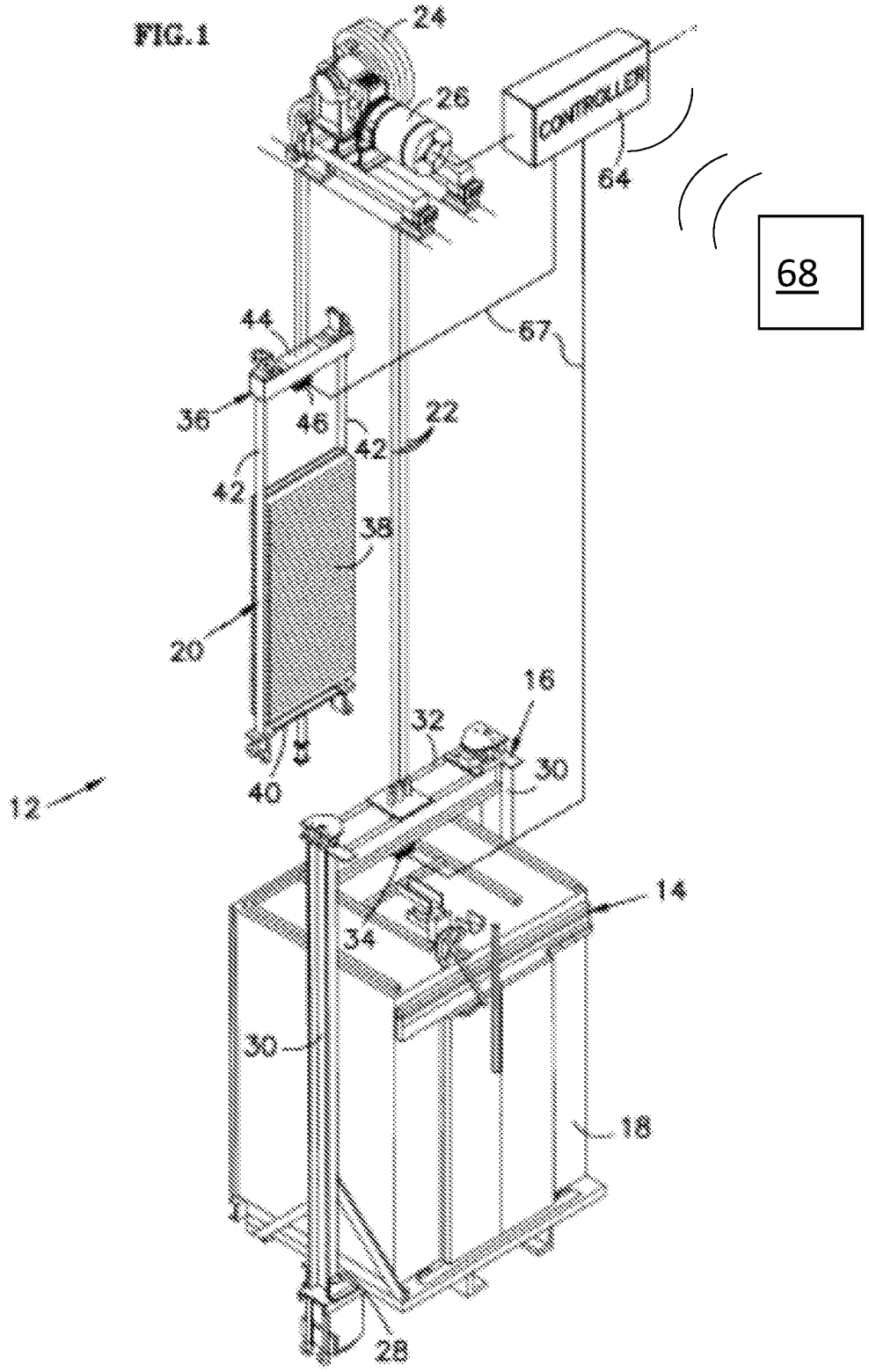
FIG. 1 is an illustration of an embodiment of an elevator system.

Referring to FIG. 1, an embodiment of an elevator system 10 is illustrated. The elevator system 12 includes a car 14 having a car frame 16 and a cab 18, a counterweight 20, a plurality of load bearing members 22, a traction sheave 24, and a machine 26. The car 14 and the counterweight 20 are connected by the plurality of load bearing members 22. The plurality of load bearing members 22 extend over the sheave 24. Rotation of the sheave 24 causes the load bearing members 22 to move, as a result of the traction forces between the sheave and load bearing members 22, and thereby moves the counterweight 20 and car 14 through a hoistway (not shown in FIG. 1). The machine 26 provides the rotational force on the sheave 24.

Figure 2:
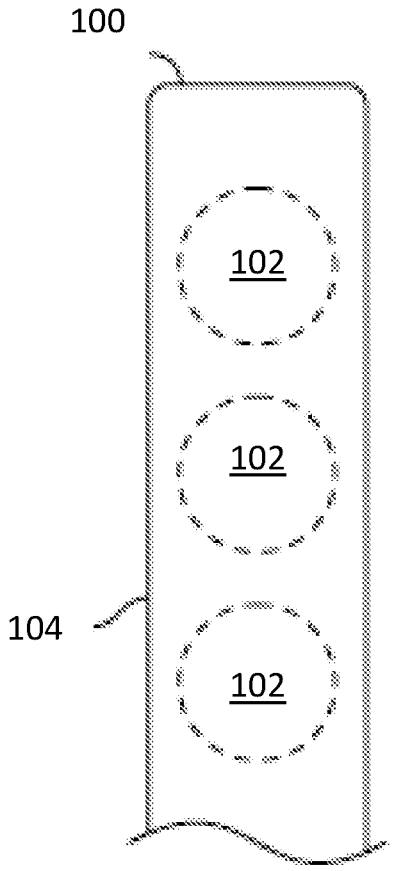
FIG. 2 is an illustration of an embodiment of a load bearing member of an elevator system.
Figure 3:
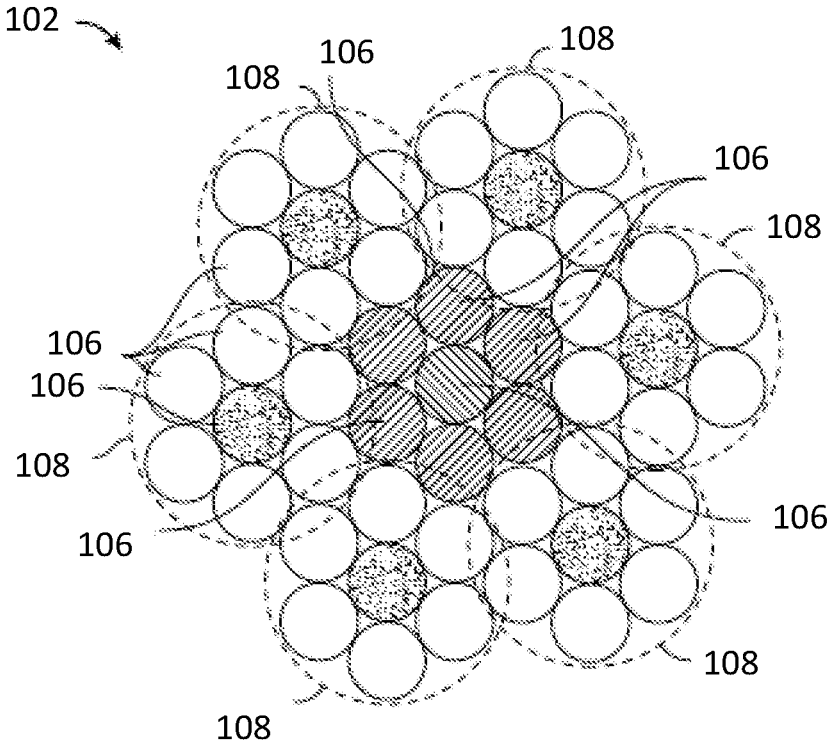
FIG. 3 is an illustration of an embodiment of a tension member for a load bearing member of an elevator system.

Referring now to FIG. 2, in some embodiments, the load bearing member 22 is a belt 100, such as the illustrated coated steel belt 100. The belt includes a plurality of tension members 102 disposed in a jacket 104. In some embodiments, as shown in FIG. 3, each tension member 102 may be formed from a plurality of wires 106 twisted into one or more strands 108 and/or cords, or tension members 102. As seen in FIG. 2, the belt 100 has an aspect ratio greater than one (i.e. belt width is greater than belt thickness). The belts 100 are constructed to have sufficient flexibility when passing over the sheave 24 to provide low bending stresses, meet belt life requirements and have smooth operation, while being sufficiently strong to be capable of meeting strength requirements for suspending and/or driving the elevator car 14. The jacket 104 could be any suitable material, including a single material, multiple materials, two or more layers using the same or dissimilar materials, and/or a film. In one arrangement, the jacket 104 could be a polymer, such as an elastomer, applied to the tension members 102 using, for example, an extrusion or a mold wheel process. In another arrangement, the jacket 104 could be a woven fabric that engages and/or integrates the tension members 102. As an additional arrangement, the jacket 104 could be one or more of the previously mentioned alternatives in combination. Further, while steel cord tension carrying members are illustrated in FIG. 2, one skilled in the art will appreciate that other materials and configurations may be utilized as tension carrying members of the belt 100. In other embodiments, the load bearing members 22 may be ropes rather than belts 100.

Referring again to FIG. 1, the car frame 16 includes a plank 28, a pair of uprights 30, and a cross-head 32. The cab 18 is disposed within the car frame 16 and is supported by the plank 28. The plurality of load bearing members 22 are connected to the cross-head 32 through a hitch assembly 34. The counterweight 20 includes a frame 36 and a plurality of weights 38. The frame 36 includes a plank 40, a pair of uprights 42, and a cross-head 44. As with the car frame 16, the load bearing members 22 are connected to the cross-head of the counterweight 20 through a hitch assembly 46.

Figure 4:
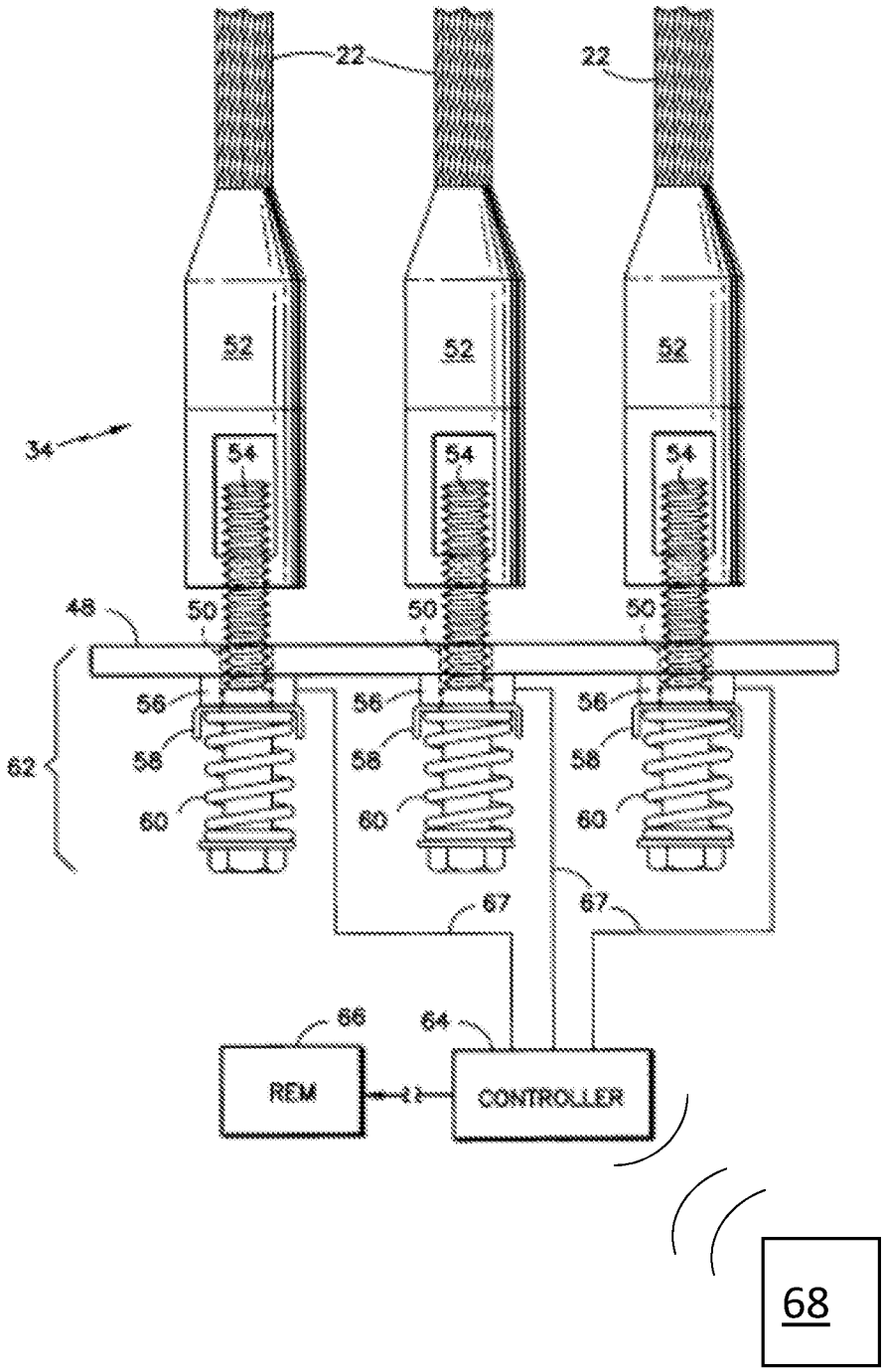
FIG. 4 is an illustration of an embodiment of a termination of a plurality of load bearing members.

The hitch assembly 34 for the car frame 16 is shown in FIG. 4. Although not illustrated in detail, the hitch assembly 46 of the counterweight 20 is similar to the hitch assembly 34 of the car frame 16. The hitch assembly 34 includes a hitch plate 48 having an aperture 50 for each of the plurality of load bearing members 22.

Each load bearing member 22 is engaged with a termination 52, a threaded rod 54, a load cell 56, a retainer 58, and a spring 60. The threaded rod 54 provides means to adjust the engagement between the termination 52 and the hitch assembly 34. The retainer 58 provides a seat for the spring 60 and mates up against the load cell 56. The spring 60 provides means to isolate the car frame 16 from vibrations in the load bearing members 22.

The load cells 56 form part of a load bearing member monitoring assembly 62. The monitoring assembly 62 includes the plurality of load cells 56 on the car frame 16 and the counterweight 20, a controller 64, a remote monitoring system 66, and means 67 to communicate between the load cells 56 and the controller and remote monitoring system 66. The load cells 56 are sensors that provide an output that corresponds to the sensed level of tension carried by the load bearing member 22 to which the load cell 56 is engaged. In this configuration, compressive forces are applied to the load cells 56 by the springs 60 and retainers 58. These compressive forces correlate with the tension in the load bearing members 22. This output is then communicated to the controller 64 and, if necessary, the controller 64 communicates a warning signal to the remote monitoring system 66. In addition to the warning signal, or in the alternative, the controller 64 may also communicate the sensed tension levels directly to the remote monitoring system 66. In an alternate embodiment, the rope monitoring system 62 does not include a remote elevator monitoring system 66 and the controller 64 stores the warning signal for later review by an on-site elevator mechanic.

Figure 5:
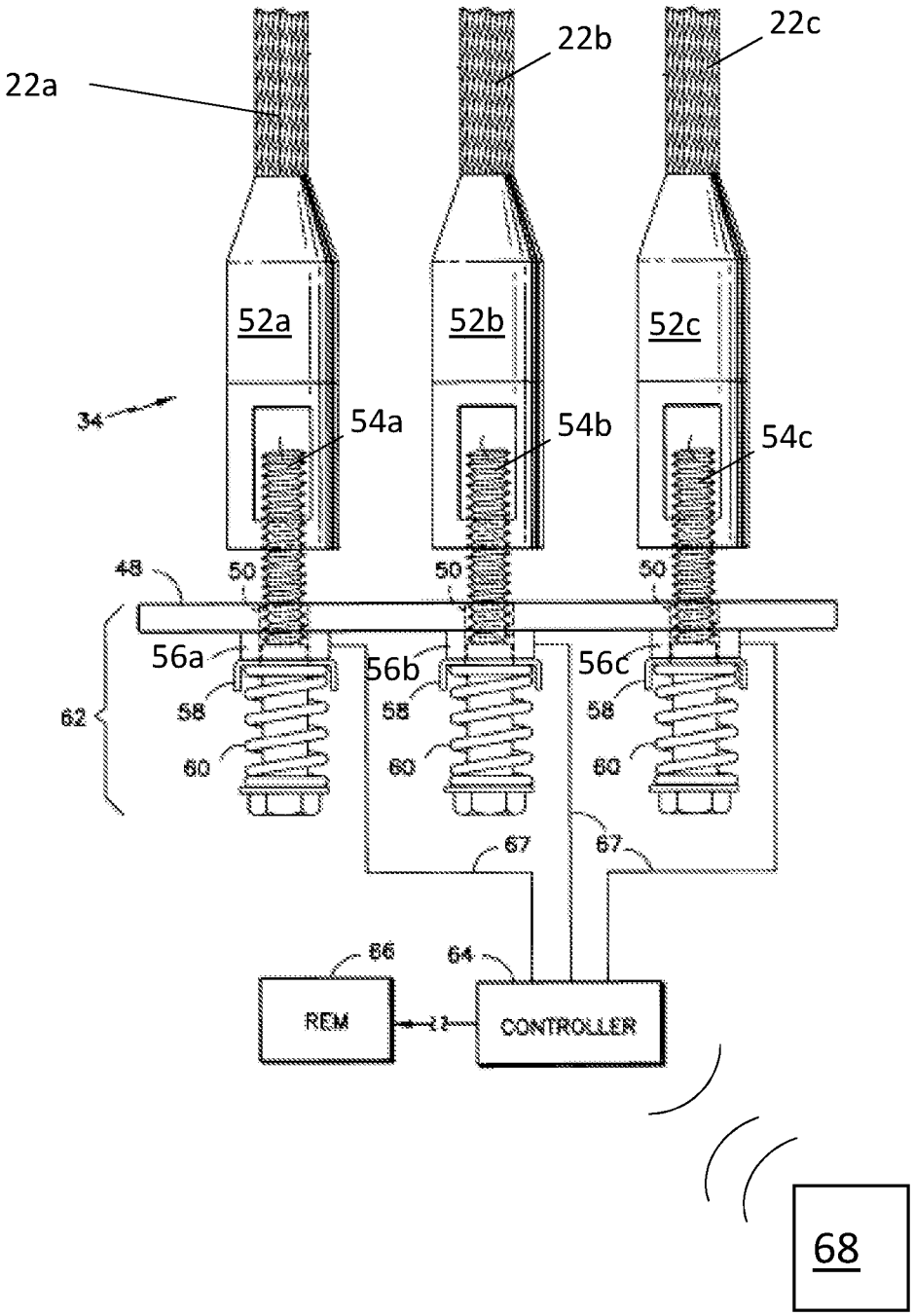
FIG. 5 is another illustration of an embodiment of a termination of a plurality of load bearing members.

Data from the load cells 56 regarding load bearing member 22 tension is utilized by an elevator mechanic to evaluate and/or adjust tension of the load bearing members 22. Referring to FIG. 5, each load bearing member **22*a*-22*c* has a corresponding termination 52*a*-52*c*, a corresponding load cell 56*a*-56*c*, and corresponding threaded rod 54*a*-54*c***.

While three load bearing members 22 and corresponding components are illustrated in FIG. 5, such a configuration is merely exemplary, and elevator systems 10 may utilize other quantities of load bearing members 22, for example, 2, 4, 5, 6 or more load bearing members 22. Data from the load cells 56*a*-56*c* is communicated to the controller 64, which is operably connected to a handheld electronic device 68, such as a smartphone or tablet, operated by the elevator mechanic. In some embodiments, the connection and communication between the controller 64 and the handheld electronic device 68 is wireless, such as via a wi-fi or Bluetooth connection. In other embodiments, the handheld electronic device 68 may be configured to communicate directly with the load cells 56*a-c*, bypassing the controller 64.

Figure 6:
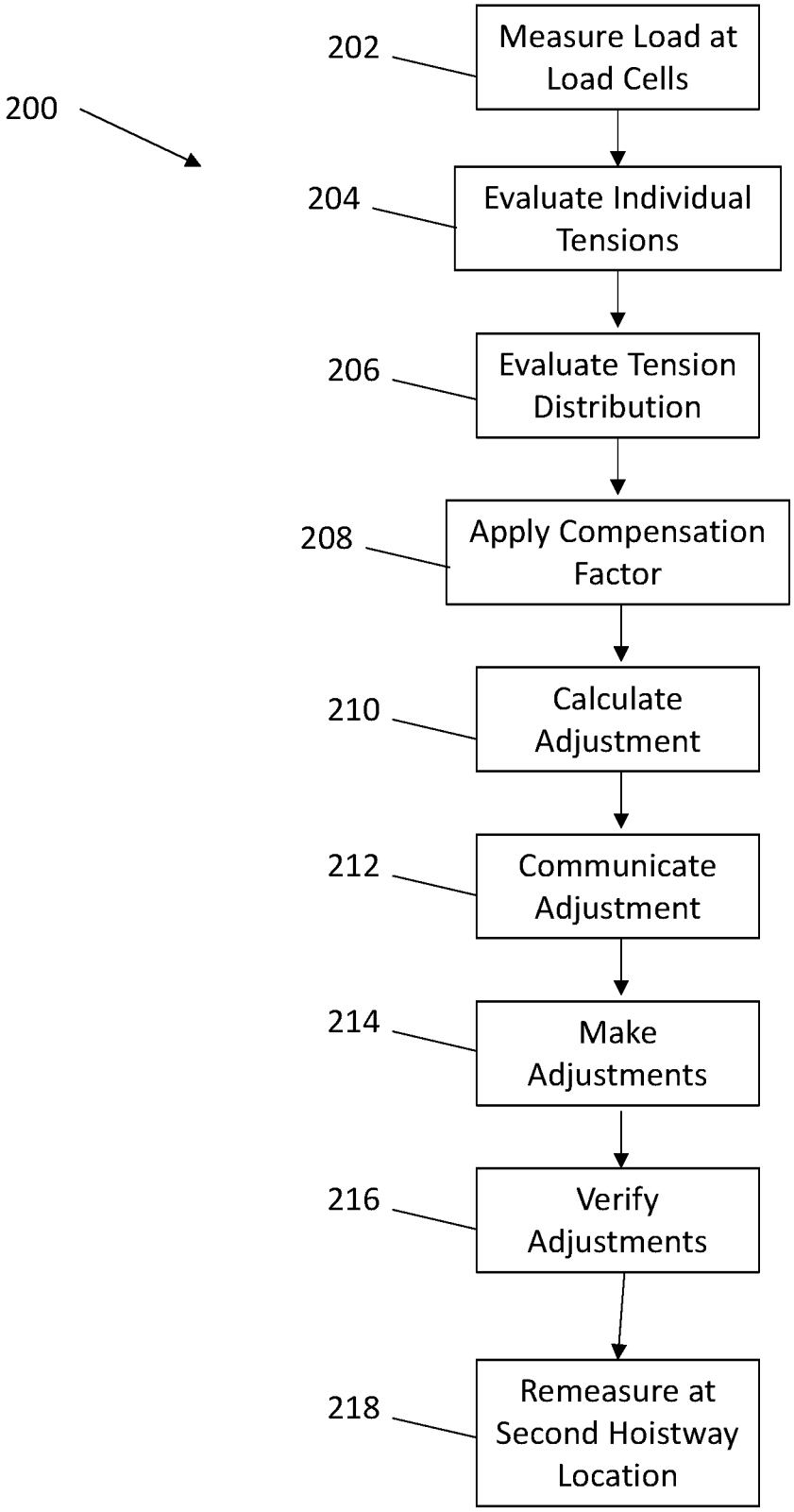
FIG. 6 is a schematic illustration of a method of adjusting tension of a load bearing member.

Referring now to FIG. 6, an example of a method 200 for evaluating and/or adjusting tension of the plurality of load bearing members 22 is shown. At step 202, the load at the load bearing members 22*a-c* is measured at the load cells 56*a*-56*c*. The measured load is equated to a tension of each load bearing member 22*a-c*.

At step 204, the measured tensions of the load bearing members 22*a-c* are evaluated compared to a predetermined individual tension range. At step 206, a tension distribution of the measured tensions are evaluated. For example, in some embodiments, each measured tension is compared to a mean tension of the measured tensions, and in some embodiments the measured tensions are compared to a minimum and maximum measured tension of the measured tensions. Such evaluations may be performed at the controller 64, and in other embodiments the evaluations are performed at the handheld electronic device 68.

At step 208, the measured tensions and the evaluations may be adjusted, or a compensation factor may be applied based on a position of the elevator car 14 in the hoistway. At step 210, an adjustment is calculated for each load bearing member 22*a-c*, either at, for example, the controller 64 or at the handheld electronic device 68. In some embodiments, the adjustment is expressed as degrees of turn of a nut 80 connected to the threaded rod 54*a-c* corresponding to each load bearing member 22*a-c*. If calculated at the controller 64, the adjustments are communicated to the handheld electronic device 64 for use by the mechanic at step 212. At step 214, the mechanic makes the appropriate adjustments to the nut 80 as directed. Once the adjustments are made, the tensions are read again at step 216 to verify that the adjustments are correct and the tension of each load bearing member 22*a-c* is within the predetermined individual tension range, and that the distribution of tensions of the load bearing members 22*a-c* is also within acceptable limits, so that the total load is distributed as desired between the load bearing members 22*a-c*.

At step 218, in some embodiments the elevator car 14 is driven to another location in the hoistway and the tensions are measured again via load cells 56*a-c* to verify that the measured tensions are within acceptable limits.

Use of device and load cells takes out error and inaccuracies in measurement of spring height and evaluation of tension via spring height. Further, mechanic time in hoistway is reduced and adjustments may be made precisely based on load cell data.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of tension adjustment for a load bearing member of an elevator system, comprising:

measuring a load on a load bearing member of an elevator system via a load cell operably connected to the load bearing member, the load cell and the load bearing member connected to an elevator car disposed in a hoistway, the measured load equated with a tension of the load bearing member;

comparing the measured tension to a preselected range;

determining an adjustment of the tension of the load bearing member;

communicating adjustment instructions to a handheld electronic device; and performing the communicated adjustment instructions thereby adjusting the tension of the load bearing member to within the preselected range;

wherein the elevator system includes a plurality of load bearing members, the method further comprising:

measuring a load of each load bearing member of the plurality of load bearing members via a corresponding plurality of load cells operably connected to each load bearing member of the plurality of load bearing members, each measured load equating to a tension of the corresponding load bearing member;

evaluating a distribution of the measured tensions of the load bearing members; and determining the adjustment of the tension each load bearing member of the plurality of load bearing members based on the evaluation of the distribution of measured tensions.

2. The method of claim 1, wherein a compensation factor is applied to the measured tension based on location of the elevator car in the hoistway.

3. The method of claim 1, further comprising:

moving the elevator car to another location in the hoistway; and remeasuring the load on the load bearing member.

4. The method of claim 1, further comprising adjusting the tension on the load bearing member by turning a nut at a connection of the load bearing member to the elevator car.

5. The method of claim 1, further comprising adjusting the tension each load bearing member of the plurality of load bearing members to achieve a preselected distribution of the measured tensions.

6. The method of claim 1, wherein the plurality of load bearing members are three or more load bearing members.

7. The method of claim 1, further comprising performing a learn run, including:

measuring a load on each load bearing member of the plurality of load bearing members at multiple positions in the hoistway;

determining a minimum average load variation between the measured loads; and utilizing the minimum average load variation in the determining the adjustment.

8. The method of claim 1, wherein the steps of:

comparing the measured tension to a preselected range; and determining an adjustment of the tension of the load bearing member are performed at the handheld electronic device.

9. The method of claim 1, wherein the handheld electronic device is one of a smart phone or a tablet.

10. A system for adjusting tension of a plurality of load bearing members of an elevator system, comprising:

a plurality of load cells, each load cell operably connected to a load bearing member of the plurality of load bearing members, each load cell configured to measure a load at the load bearing member, the measured load equating to a tension on the corresponding load bearing member;

a controller operably connected to the plurality of load cells configured to:

evaluate the plurality of measured tensions with respect to one or more preselected ranges;

evaluate a distribution of the measured tensions of the load bearing members; and determine an adjustment of the tension each load bearing member of the plurality of load bearing members based on the evaluation of the distribution of measured tensions;

and a handheld electronic operably connected to the controller configured to receive the adjustment instruction of each load bearing members of the plurality of load bearing members.

11. The system of claim 10, further comprising a nut operably connected to each load bearing member of the plurality of load bearing members, wherein rotation of the nut adjusts the tension of the associated load bearing member.

12. The system of claim 10, wherein the handheld electronic device is wirelessly connected to the controller.

13. The system of claim 10, wherein the handheld electronic device is one of a smart phone or a tablet.

14. The system of claim 10, wherein the plurality of load bearing members is three or more load bearing members.

15. The system of claim 10, wherein the plurality of load bearing members include a plurality of ropes or a plurality of belts.

* * * * *